United States Patent [19]

Post

[11] Patent Number: 4,527,141

[45] Date of Patent: Jul. 2, 1985

[54] TRANSFORMER COMPRISING A WOUND COIL FORMER

[75] Inventor: Sieghard Post, Guntersdorf, Fed. Rep. of Germany

[73] Assignee: U.S. Philips Corporation, New York, N.Y.

[21] Appl. No.: 481,113

[22] Filed: Apr. 1, 1983

[30] Foreign Application Priority Data

Apr. 1, 1982 [DE] Fed. Rep. of Germany ..... 3212061

[51] Int. Cl.[3] ..... H01F 15/10

[52] U.S. Cl. ..... 336/192

[58] Field of Search ..... 336/198, 208, 192; 310/71

[56] References Cited

U.S. PATENT DOCUMENTS

| | | | |
|---|---|---|---|
| 2,653,992 | 9/1953 | Hill | 336/208 X |
| 3,947,795 | 3/1976 | Donnelly et al. | 336/192 |
| 4,166,265 | 8/1979 | Reynolds et al. | 336/192 |
| 4,318,069 | 3/1982 | Morse | 336/192 |

FOREIGN PATENT DOCUMENTS

| | | | |
|---|---|---|---|
| 2226034 | 12/1973 | Fed. Rep. of Germany | 336/192 |
| 2224176 | 3/1980 | Fed. Rep. of Germany | 336/192 |
| 1077898 | 8/1967 | United Kingdom | 336/192 |

*Primary Examiner*—Thomas J. Kozma

*Attorney, Agent, or Firm*—Robert T. Mayer; Bernard Franzblau

[57] ABSTRACT

A transformer comprising a wound coil former (1) with first and second coil flanges (5) located at opposite ends of the coil former. At least one strip (13) comprising connection eyelets arranged on the first coil flange and connected to winding wire ends (9) emerging from the winding (7). Guide pins (21) are arranged on an edge portion (19) of the second flange which, viewed throughout the surface (17) of the winding (7), is located opposite the flange edge portion (15) of the first flange. The winding wire ends (9) are tensioned around the guide pins and are then guided to the connection eyelets (11) of the connection strip without adhesion.

2 Claims, 1 Drawing Figure

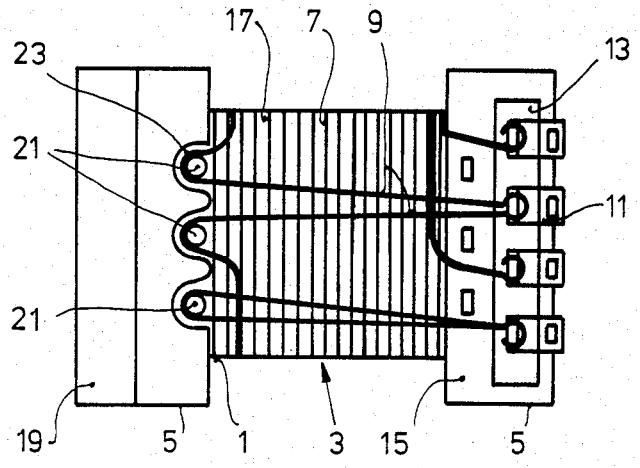
17
7
9
23
13
21
11
21
19
5
1
3
15
5

TRANSFORMER COMPRISING A WOUND COIL FORMER

This invention relates to a transformer comprising a wound coil former with coil flanges and at least one strip comprising connection eyelets arranged on a coil flange and connected to winding wire ends emerging from the winding.

In transformers, more particularly in transformers having several winding wire ends emerging from the winding, it is common practice to fix the winding by means of an adhesive tape before the wire ends emerge from the winding. This processing step is laborious and can hardly be automated.

The invention has for an object to provide, in a transformer of the kind mentioned in the preamble a means for simplifying, and more particularly of automating, the process of fixing the winding before the wire ends emerge from the winding.

According to the invention, this object is achieved in that guide pins are arranged on a flange edge portion which, viewed throughout the surface of the winding, is located opposite a flange edge portion of the opposite flange provided with a strip comprising connection eyelets, and in that the winding wire ends are tensioned around the guide pins so as to be guided to the connection eyelets of the connection strip.

The use of the guide pins makes it possible first to tension the wire ends around the guide pins so as to fix the winding. Subsequently, the wire ends are freely guided from the guide pin to the connection eyelets.

According to a further embodiment of the invention, it is ensured that guide tracks for wire guides are provided around the guide pins. By means of the guide tracks the wire guides can be guided around the individual guide pins so that the winding ends can be guided fully automatically to the connection eyelets. Any intermediate processing steps for fixing the winding form can now be dispensed with.

The invention will now be described more fully with reference to the embodiment shown in the drawing.

The drawing is a plan view of a transformer comprising a winding form and a transformer winding, in which the wire ends are first tensioned around guide pins and are then passed to the connection eyelets.

The coil former 1 of a transformer 3 is provided between its flanges 5 with a winding 7. This winding consists of several subwindings having connection wire ends 9 that are guided to connection eyelets 11 on a strip 13 comprising connection eyelets.

The connection strip 13 is secured to a flange edge portion 15, which in the plan view of the transformer is arranged on the righthand side. Viewed throughout the surface 17 of the winding 7, this flange edge portion 15 has arranged opposite to it a flange edge portion 19 of the other flange 5. Guide pins 21, which in the drawing extend upright, are arranged on the flange edge portion 19. These guide pins 21 are in recesses, which together with the guide pins, form surrounding guide tracks 23 for a wire guide, which is not shown.

In conventional transformer windings, the wire ends 9 are adhered by means of an adhesive tape before they are passed to the connection eyelets 11 so that the winding cannot become detached. After the adhesion step, which is generally effected manually, the connection wire ends 9 are passed to the connection eyelets 11.

The guide pins 21 are now utilized instead of the adhesion step used hitherto. After the termination of the winding process of the single winding the wire guide guides the individual wire ends 9 first so as to be tensioned around one of the guide pins 21. Thus, the winding is fixed and cannot become detached. The connection wire end is then pulled transversely across the winding 7 to the connection eyelet 11 and is fixed or soldered there.

What is claimed is:

1. A transformer comprising a wound coil former having first and second coil flanges located at opposite ends of the coil former, at least one strip comprising connection eyelets arranged on an edge portion of the first coil flange and connected to winding wire ends emerging from the winding, a plurality of recesses in an edge portion of the second flange, each recess containing a guide pin, facing surfaces of each recess and said guide pin therein defining a guide track for wire guides, the second flange edge portion, viewed throughout the surface of the winding, being located opposite the edge portion of the first flange, the winding wire ends being tensioned around the guide pins so as to be guided to the connection eyelets of the connection strip.

2. A transformer comprising: a coil former having first and second flanges at opposite ends of the coil former, at least one winding wound on said coil former including a plurality of sub-windings having connection wire ends which emerge from the winding, a connection strip secured to the first flange and comprising a plurality of connection eyelets connected to said connection wire ends that emerge from the winding, a plurality of recesses in an edge portion of the second flange, each recess containing a guide pin, facing surfaces of each recess and said guide pin therein, defining a guide track for wire guides, the connection wire ends being tensioned around the guide pins so as to secure the winding and to automatically guide the connection wire ends to their respective connection eyelets on the connection strip.

* * * * *